US005350894A

United States Patent [19]

Allison

[11] Patent Number: 5,350,894

[45] Date of Patent: Sep. 27, 1994

[54] TWO PIECE SWITCH ASSEMBLY FOR MEMBERS THAT MOVE RELATIVE TO ONE ANOTHER IN A FIXED MANNER

[75] Inventor: Johnny H. Allison, Redford, Mich.

[73] Assignee: Ford Motor Company, Dearborn, Mich.

[21] Appl. No.: 82,563

[22] Filed: Jun. 28, 1993

[51] Int. Cl.[5] ..... H01H 15/06

[52] U.S. Cl. ..... 200/549; 200/550; 200/61.061; 200/61.071; 362/155

[58] Field of Search ..... 200/549, 550, 547, 252, 200/257, 61.61, 61.62, 61.71, 61.72, 61.73, 61.74, 61.76, 61.75, 310; 362/155

[56] References Cited

U.S. PATENT DOCUMENTS

| | | | |
|---|---|---|---|
| 484,577 | 10/1892 | Baumann | 200/61.61 |
| 3,193,673 | 7/1965 | Herring | 200/61.62 |
| 3,622,720 | 11/1971 | Allen | 200/61.62 |
| 4,101,745 | 7/1978 | Smith | 200/61.61 |
| 4,160,887 | 7/1979 | Van Buren, Jr. | 200/61.62 |
| 4,511,771 | 4/1985 | Rossell | 200/61.62 |
| 4,514,603 | 4/1985 | Staples | 200/61.62 |
| 4,546,419 | 10/1985 | Johnson | 200/310 |
| 4,554,618 | 11/1985 | Bafunno et al. | 200/61.62 |
| 5,140,116 | 8/1992 | Schmitt-Walter | 200/310 |

*Primary Examiner*—Henry J. Recla
*Assistant Examiner*—David J. Walczak
*Attorney, Agent, or Firm*—Mark L. Mollon; Roger L. May; Kevin G. Mierzwa

[57] ABSTRACT

A two-piece switch is mounted on two members which slidably move in a fixed relation to each other. One portion of the switch, mounted to the stationary member, has a contact recessed within for connecting to a power source. The first portion has flexible insulators over the contact. The second portion, mounted to the slidable member, has a retractable contact and an independently retractable insulator. When the switch portions are brought together as the members are moved, the flexible insulators are deformed to expose a portion of the contact by the retractable insulator. The contacts are then electrically connected.

15 Claims, 6 Drawing Sheets

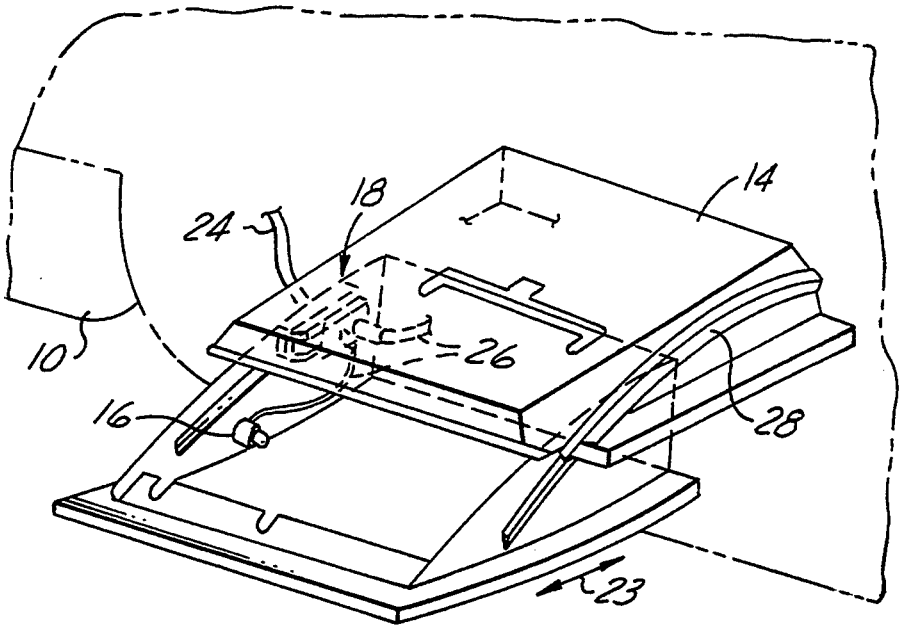
FIG. 1
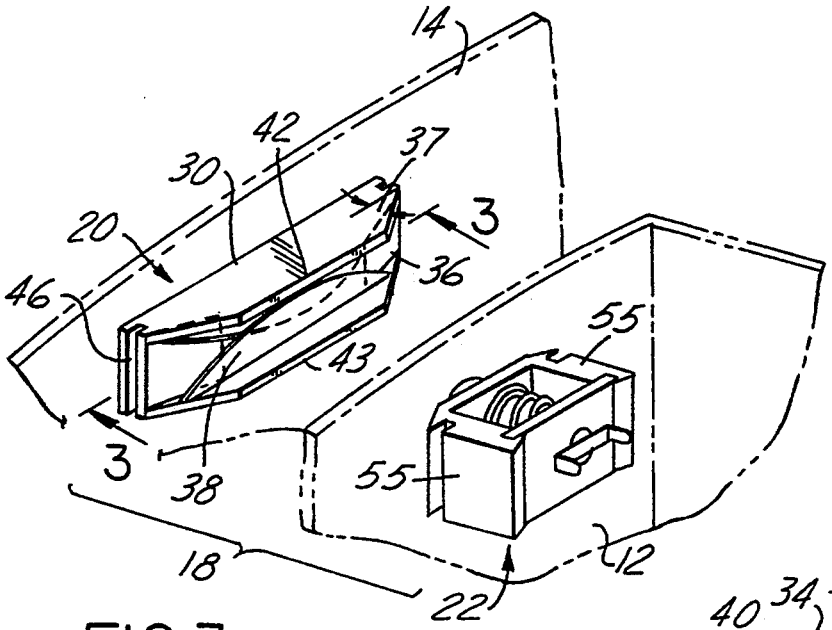
FIG. 2
FIG. 3
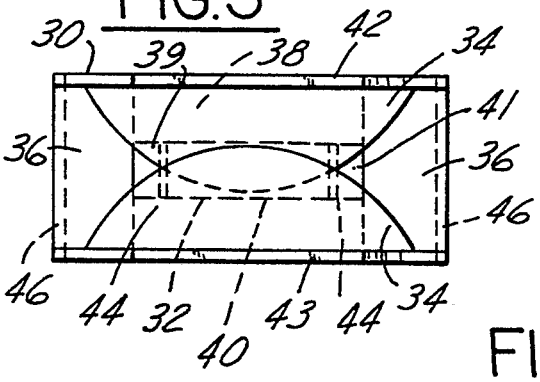
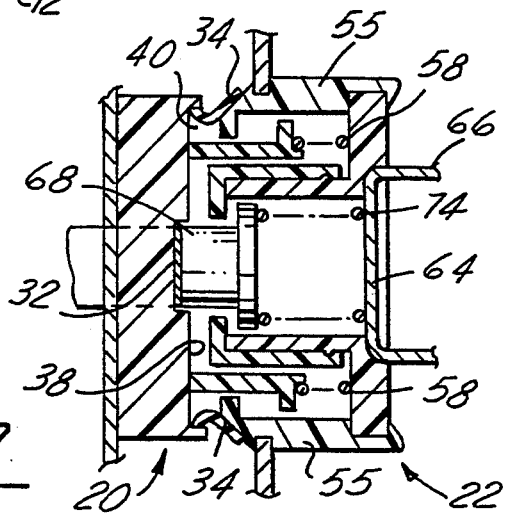
FIG. 7

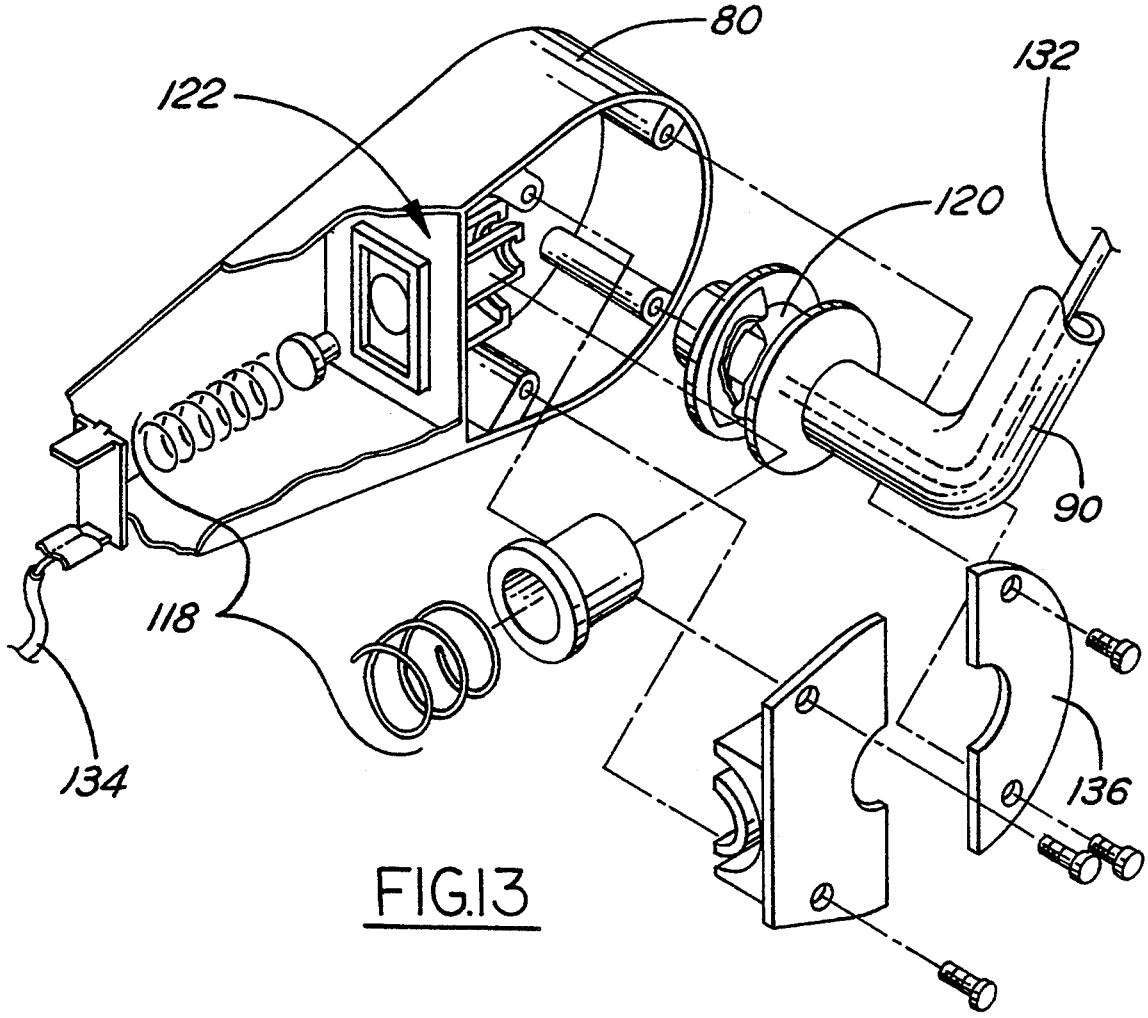
FIG.13
FIG.14
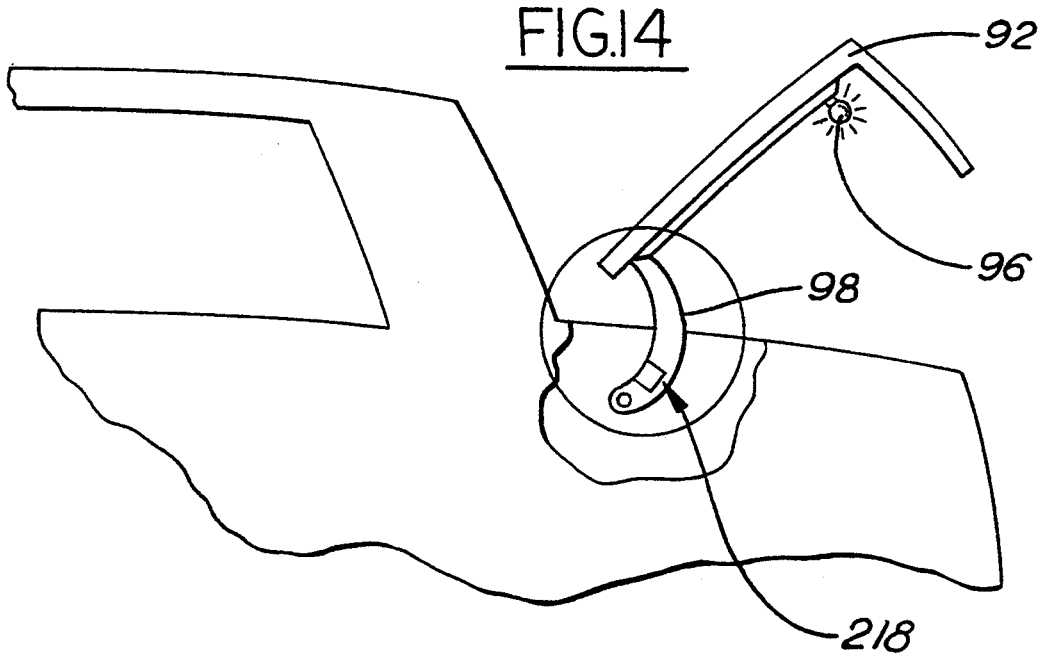

TWO PIECE SWITCH ASSEMBLY FOR MEMBERS THAT MOVE RELATIVE TO ONE ANOTHER IN A FIXED MANNER

BACKGROUND OF THE INVENTION

The invention relates generally to switches and more specifically to a two-piece switch assembly adapted for mounting on two members that move relative to one another in a fixed manner.

One example of two moving members is a common automobile ashtray consisting of two potions, a slidable ashtray and a frame. The frame mounts in the instrument panel to hold the ashtray in a drawer-like fashion. Guide tracks on the frame guide the ashtray as it moves into and out of the frame.

The ashtray may be illuminated in various ways. For example, a light bulb may be mounted inside the frame above the ashtray. A problem associated with this design is that the ashtray is not fully lit when it is fully extended, especially the portion of the ashtray furthest from the frame.

Alternatively, the light bulb can be mounted directly to the sliding ashtray, thereby providing a more complete illumination. However, such prior art systems have required a durable wiring harness capable of flexing as the ashtray is moved into and out of the frame. Thus, an expensive, heavy-gauge wiring harness is used for supplying power to the ashtray-mounted light bulb.

A further problem associated with prior illuminated ashtrays is that the operation of the light depends only on the position of the vehicle headlamp switch. Thus, when the vehicle headlamps are on, the ashtray light remains on even when the ashtray is not extended, thereby reducing the lifetime of the lightbulb.

Another example of two members moving relative to one another is a deck lid which moves on a hinge relative to a body panel. A typical deck lid includes a mercury switch in conjunction with a heavy gauge wiring harness to illuminate a light for the luggage compartment upon opening. However, these switches are undesirable because of their cost and environmental considerations.

Yet another example of two members moving relative to one another is the swivel am of a sun visor. The ann rotates relative to a post which fixes the sun visor to the frame of the automobile. Many sun visors have illuminated mirrors and consequently, power must be provided to the sun visor. Typically, power is provided using a heavy gauge wiring harness capable of flexing as the sun visor is rotated and swivelled. However, a flexible wiring harness is expensive.

It would be desirable for a switch to provide power and eliminate the need for a flexible wiring harness.

SUMMARY OF THE INVENTION

An object of the invention is to provide a two-piece switch whose contacts remain insulated when the two pieces of the switch are disconnected. Also, when the switch is in the closed position, the insulators allow the electrical contacts to connect while preventing the contacts from being exposed to the outside of the switch.

Briefly, a preferred embodiment of the present invention includes a stationary member including a guide for defining a slide path and including a power terminal disposed in a predetermined relation to the slide path. A sliding member has a follower means for mating with the guide on the stationary member. The sliding member also has contact means in a predetermined relation to the slide path for contacting the power terminal when the sliding member is moved in relation to the stationary member and has an electrical load for receiving power when the contact means is electrically connected to the power terminal.

One advantage is that it is less expensive to provide a switch rather than providing a heavy gauge wiring harness.

BRIEF DESCRIPTION OF THE DRAWINGS

FIG. 1 is a perspective view of an instrument panel with an ashtray fully extended.

FIG. 2 is an enlarged perspective view of a switch according to the present invention.

FIG. 3 is a side view of the base plate portion of the switch.

FIG. 7 is a side cross-sectional side view of the switch in the "on" position.

FIG. 13 is an exploded view of the two switch portions in a sun visor.

FIG. 14 is a plan view of the of the switch mounted on the deck lid of an automobile.

DETAILED DESCRIPTION OF THE PREFERRED EMBODIMENT

Figure 4:
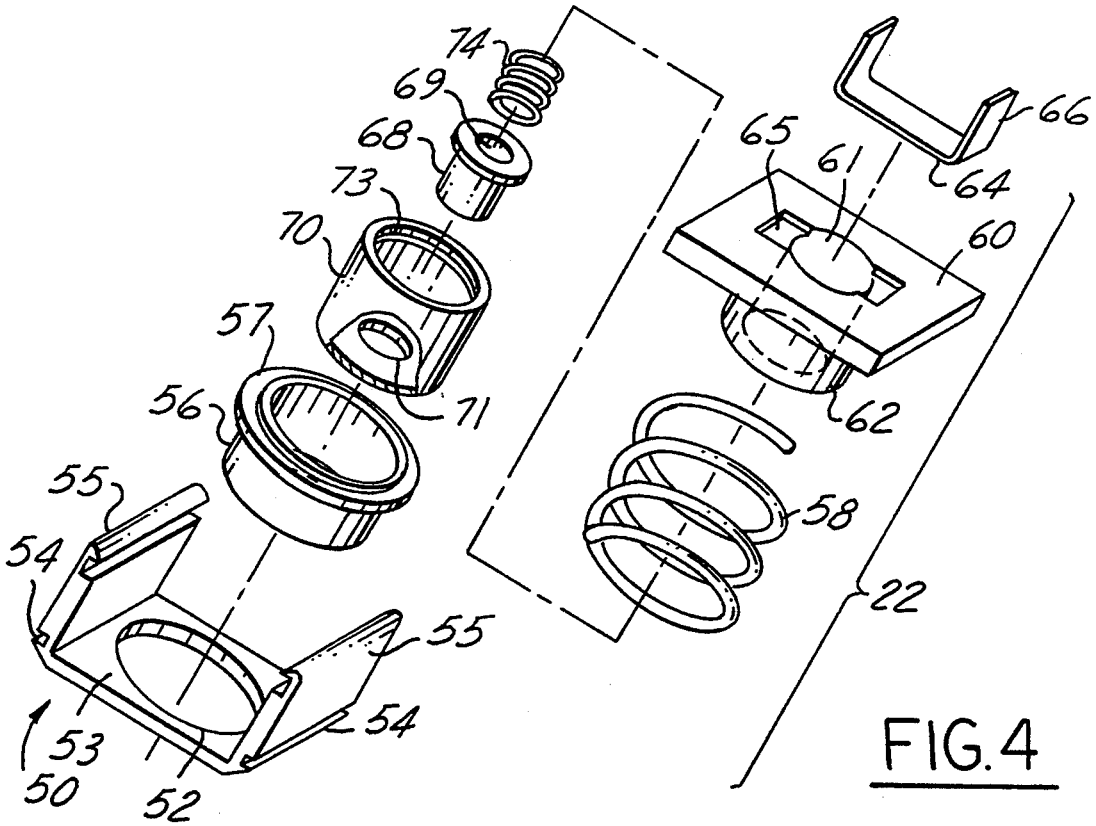
FIG. 4 is an exploded view of the slide connector portion of the switch.

Referring to FIG. 1, a stationary member such as an ashtray frame 14 supports a moveable member such as an ashtray 12 within an instrument panel 10 of an automobile (not shown). A switch 18 is used to provide power to a light 16 and/or a cigar lighter (not shown) mounted on ashtray 12. A wire 24 connects switch 18 to an electrical source (not shown) such as an automobile battery. Internal wiring 26 connects switch 18 to light bulb 16 or other electrical loads (not shown). Guide tracks 28 on either side of ashtray frame 14 are used to guide ashtray 12 into and out of ashtray frame 14 in direction 23. When ashtray 12 is extended, as shown, switch 18 completes a circuit between light 16 and power supplied by wires 24.

Referring now to FIGS. 2 and 3, switch 18 is comprised of two portions; a base plate 20 and a slide connector 22. Base plate 20 is snap-fit into an opening in ashtray frame 14. Base plate 20 is comprised of a housing 30, a conductive pad 32, and a pair of insulators 34. The exterior of housing 30 is generally rectangular and has grooves 46 on its longitudinal ends which retain ashtray frame 14 therein. Housing 30 is made of an insulative material such as plastic. Vertical side 38 and horizontal walls 42 and 43 form a generally a C-shaped opening. One portion of vertical side 38 has a sloped surface 36 forming an acute angle 37 with the edge of housing 30. A rectangular channel 40 with sloped ends 39 and 41 is centrally located in vertical side 38. Within channel 40, conductive pad 32 forms the vertical surface of channel 40 and includes at least one terminal pin 44 extending therefrom to connect to an electrical source. Semi-circular insulators 34 and 35, made of a pliant material such as robber, are fastened with adhesive at their base to walls 42 and 43, respectively, in a manner to overlay conductive pad 32. Insulators 34 and 35 are deformable flaps which selectably cover and uncover conductive pad 32. The semi-circular shape provides preferred characteristics for elastically deforming and exposing conductive pad 32 in response to sliding movement of slide connector 22, as described below.

Referring now to FIGS. 2 and 4, slide connector 22 is comprised of a housing 50 that is snapped into an appropriately-sized opening in a side wall of ashtray 12. Housing 50 is preferably formed of an insulative material such as plastic and is retained in the opening by grooves 54 on its longitudinal ends. Housing 50 has rectangular base 53 with a hole 52. Base 53 has two walls 55 extending perpendicularly from its longitudinal ends for securing a lid 60 therebetween. A tubular extension 62 is integrally formed in lid 60 to provide a bore 61 Extension 62 has retaining ribs 63 (FIG. 5) formed on its exterior surface adjacent to lid 60. An electrical contact 64 is snap-fit within a groove 65 and encloses one end of bore 61. A terminal pin 66 extends from contact 64 providing an electrical connection point for an electrical load such as a light or a cigar lighter (not shown).

Extension 62 receives a contact 68 which is generally cylindrical-shaped with one end closed and one end open with an outwardly-turned lipped edge 69. The outside diameter of lipped edge 69 is slightly smaller than the inside diameter of extension 62 so that when contact 68 is placed within extension 62, it moves freely. A retainer 70, used to hold contact 68 within the extension 62, is a generally tubular piece whose inner diameter is slightly larger than the outer diameter of tubular lid extension 62. The end of retainer 70 bearing against lid 60 is open and the other end has a lipped edge 72 which extends inward leaving an opening 71 whose diameter is large enough to allow the closed end of contact 68 to extend through opening 71. The diameter of lipped edge 69 of contact 68 is larger than opening 71, thus contact 68 will be retained within tubular extension 62. A groove 73 on the inner surface of retainer 70 mate with fibs 63 on tubular extension 62 to hold retainer 70 in place. A retainer spring 74 is placed between contact 68 and contact 64 to urge contact 68 through opening 72. Retainer spring 74 is made of an electrically conductive material so that contact 64, retainer spring 74, and contact 68 are electrically connected. When fully extended, contact 68 protrudes through hole 52 in housing 50. Contact 68 is preferably narrower than conductive pad 32 in base plate 20.

A connector insulator 56, which is a tube-shaped piece preferably made of plastic or other insulative material normally extends through hole 52 a greater distance than contact 68. Insulator 56 has an outer diameter smaller than the diameter of hole 52 and greater than the width of contact channel 40 in base plate 20 (as shown in FIG. 3). One end of connector insulator 56 has a lip 57 with a diameter larger than the diameter of hole 52. Insulator 56 extends through housing 50 and is retained within housing 50 by lip 57. Lip 57 is urged against base 53 by a coil spring 58 whose opposite end bears against lid 60.

Figure 5:
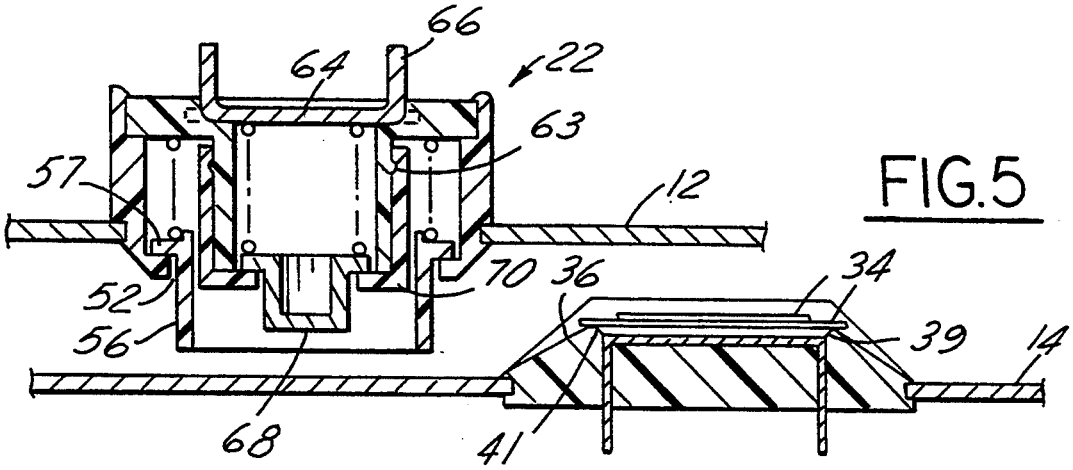
FIG. 5 is a top cross-sectional view of the switch in the "off" position.

Referring now to FIG. 5, a cross section of base plate 20 is shown in relation to slide connector 22 when ashtray 12 is in an unopened position (i.e., the switch is in the "off" position). Connector insulator 56 is fully extended through hole 52 of housing 50. Contact 68 is also in its fully extended position through retainer 70 but is shielded by insulator 56 and thus protected from inadvertent contact from items placed in the ashtray.

Figure 6:
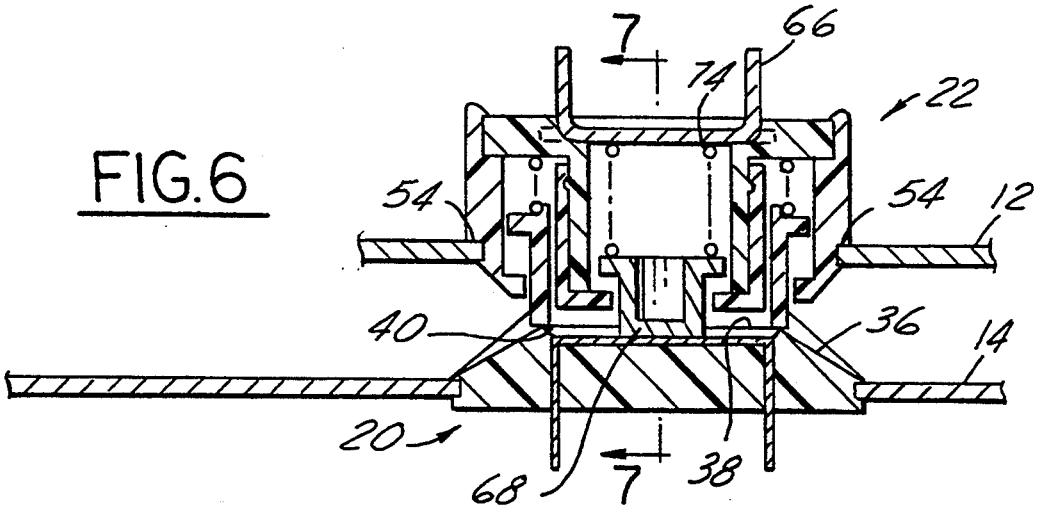
FIG. 6 is a top cross-sectional view of the switch in the "on" position.

Referring now to FIGS. 6 and 7, when ashtray 12 is opened, slide connector 22 moves toward the stationary base plate 20. When slide connector 22 reaches angular slope 36 of base plate 20, connector insulator 56 is forced into housing 50 as it is moved along angular slope 36. As connector insulator 56 moves along the slope, insulators 34 are deformed to expose conductive pad 32 surface below the insulators 34 in channel 40. When slide connector 22 reaches the end of angular slope 36 (i.e., vertical side 38), contact 68 is also in a partially retracted position as it is urged into housing 50 by vertical side 38 of base plate 20. Contact 68 and insulator 56 remain in a retracted position until contact 68 clears sloped end 41. When slide connector 22 moves over conductive pad 32, vertical side 38 of base plate 20 retains connector insulator 56 in a retracted position and contact 68 is urged into channel 40 by retainer spring 74 until contact 68 and conductive pad 32 become electrically connected. As a result a completed circuit is formed through switch 18.

In operation, when use of ashtray 12 is required, it is pulled out of frame 14. When ashtray 12 is in the open position, base plate 20 and slide connector 22 engage causing conductive pad 32 and conductor 64 to provide electric power to an electric load such as a light and/or a lighter.

Ground return for the circuit can be provided in several ways. First, ashtray frame 14 and ashtray 12 can be made of a conductive material to provide the ground portion of the circuit. Second, if a non-conductive frame and ashtray are desired a separate switch assembly can be provided for the ground connection. Thus, power is only provided when the sliding compartment is in the open position.

Figure 8:
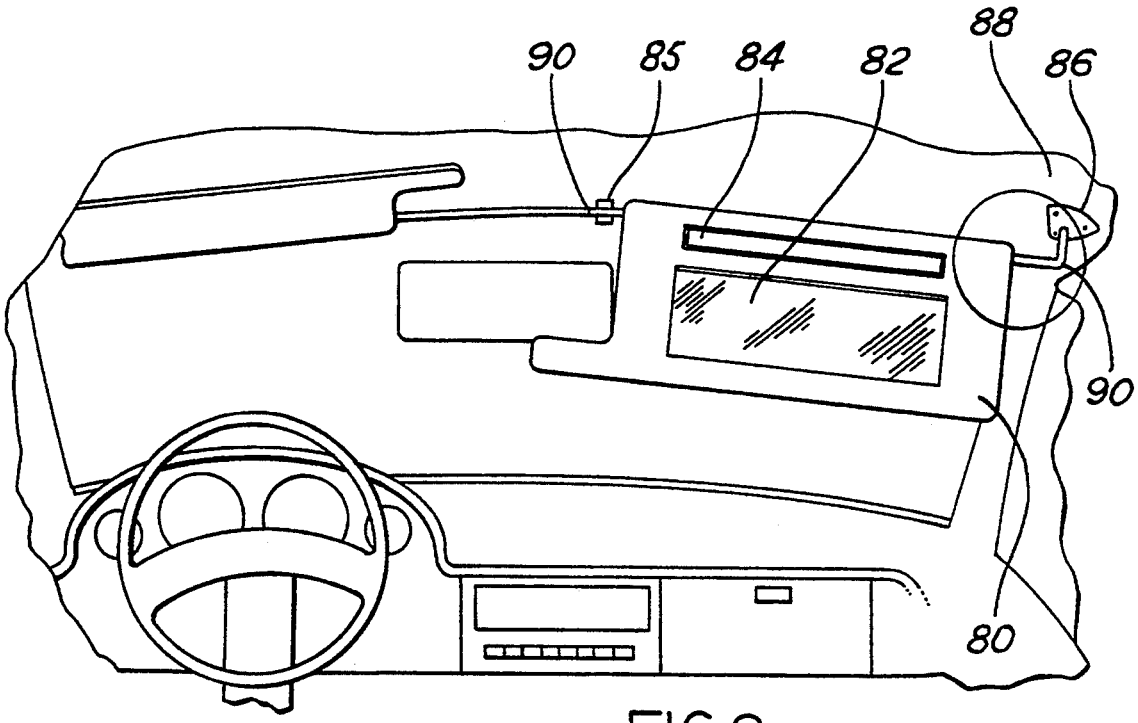
FIG. 8 is an alternative embodiment of the switch mounted on a sun visor.
Figure 9:
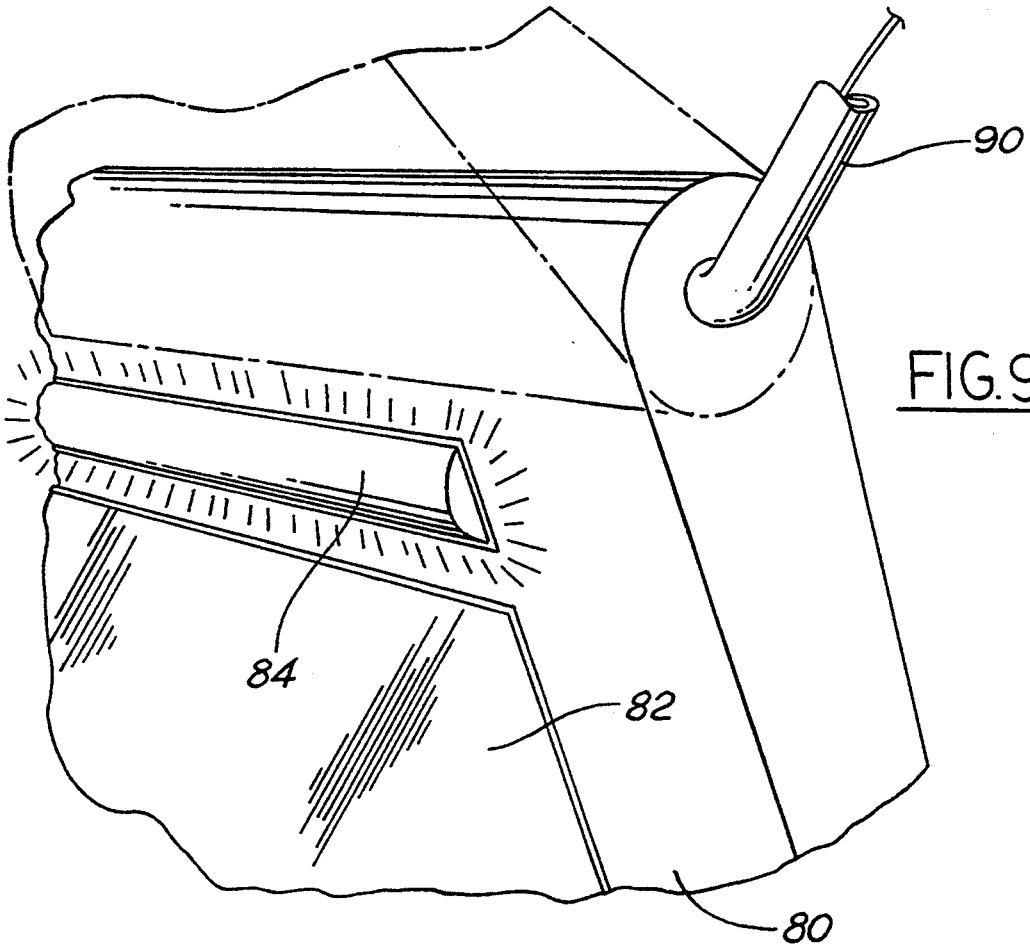
FIG. 9 is an enlargement of the portion of the sun visor containing the switch.
Figure 10:
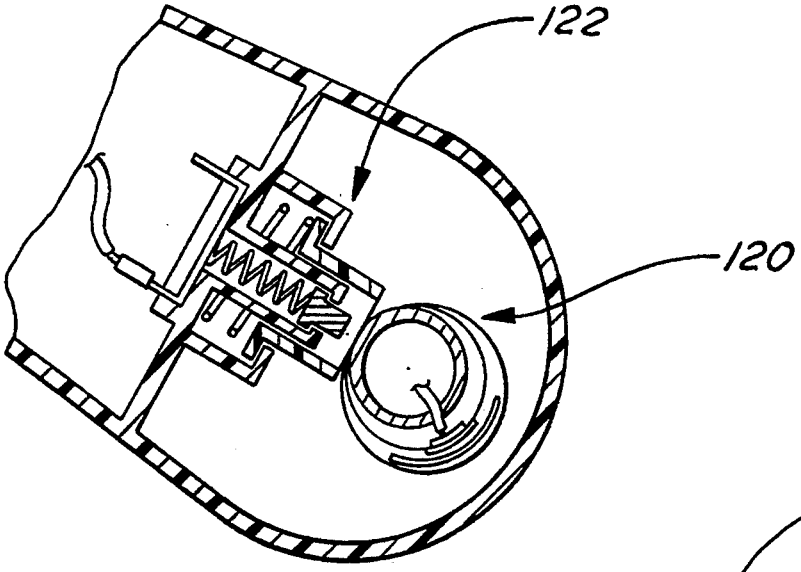
FIG. 10 is a cross section of the sun visor in the up position ant the switch in the off position.
Figure 11:
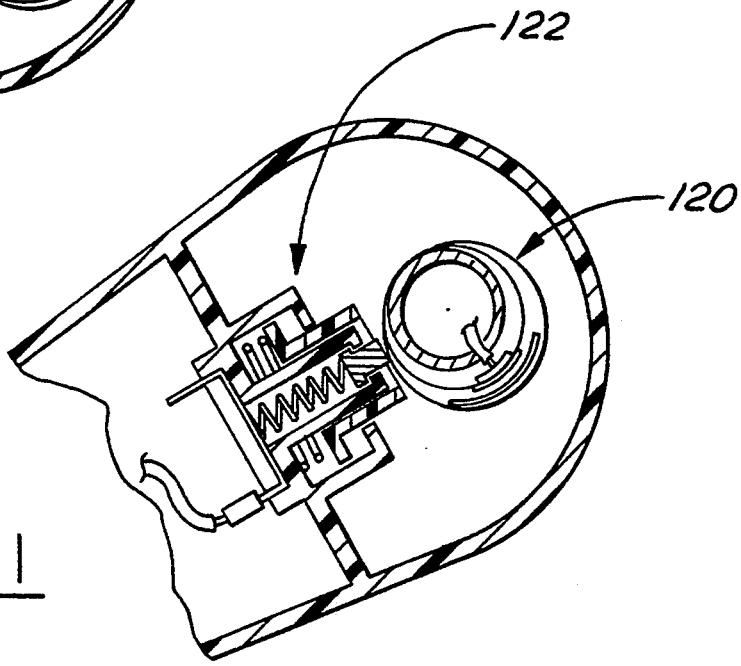
FIG. 11 is a cross section of the sun visor in the partially retracted position.
Figure 12:
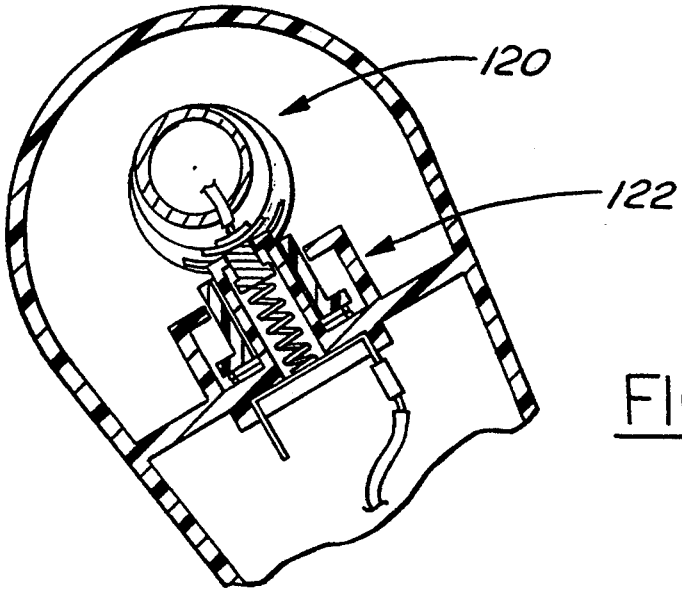
FIG. 12 is a cross section of the sun visor in the down position and the two switch portions electrically contacting.

Referring now to FIGS. 8 and 9, the switch can also be adapted to fit on a sun visor 80. Sun visor 80 has a mirror 82 and a fight 84. The switch is located so that when the sun visor 80 is rotated downward, it electrically connects a power source (not shown) to light 84.

Sun visor 80 is fastened to an automobile roof 88 or frame member by a stationary mount 86. Sun visor 80 has a swivel ann 90 which rotates about stationary mount 86 and guides the sun visor 80 for movement in a fixed path. Swivel arm 90 is releasably secured at its distal end by a clip bracket 85 mounted to roof 88. The electrical switch can be incorporated in clip bracket 85 or can be contained within sun visor 80 as described below.

Referring now to FIGS. 10–13, baseplate 120 is fixedly mounted on swivel arm 90. Slide connector 122 is fixedly mounted to sun visor 80. When the sun visor 80 is rotated from the up position (FIG. 10) to the down position (FIG. 12), baseplate 120 electrically connects to slide connector 122, thus fight 84 is illuminated.

In FIG. 13, a wire 132 is connected from the power source (not shown) to base plate 120 through a conduit in hollow swivel arm 90. Base plate 120 is an integral part of swivel ann 90. Switch 118 is enclosed in sun visor 80 by cover 136. A wire 134 connects slide connector 122 to the sun visor fight (not shown).

Figure 15:
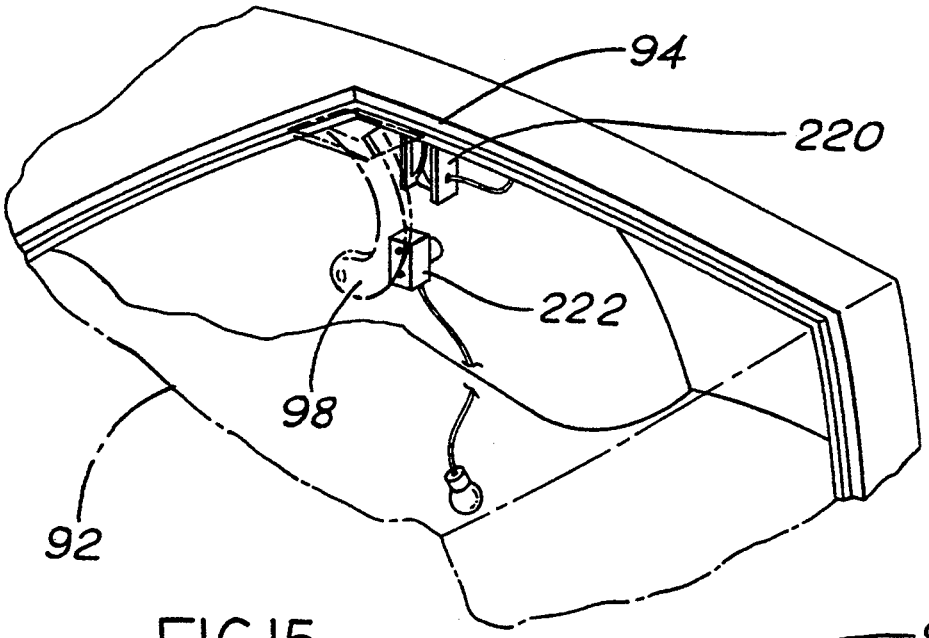
FIG. 15 is an enlarged plan view of the switch mounted on a deck lid hinge when the decklid is in the closed position and the switch is in the open position.
Figure 16:
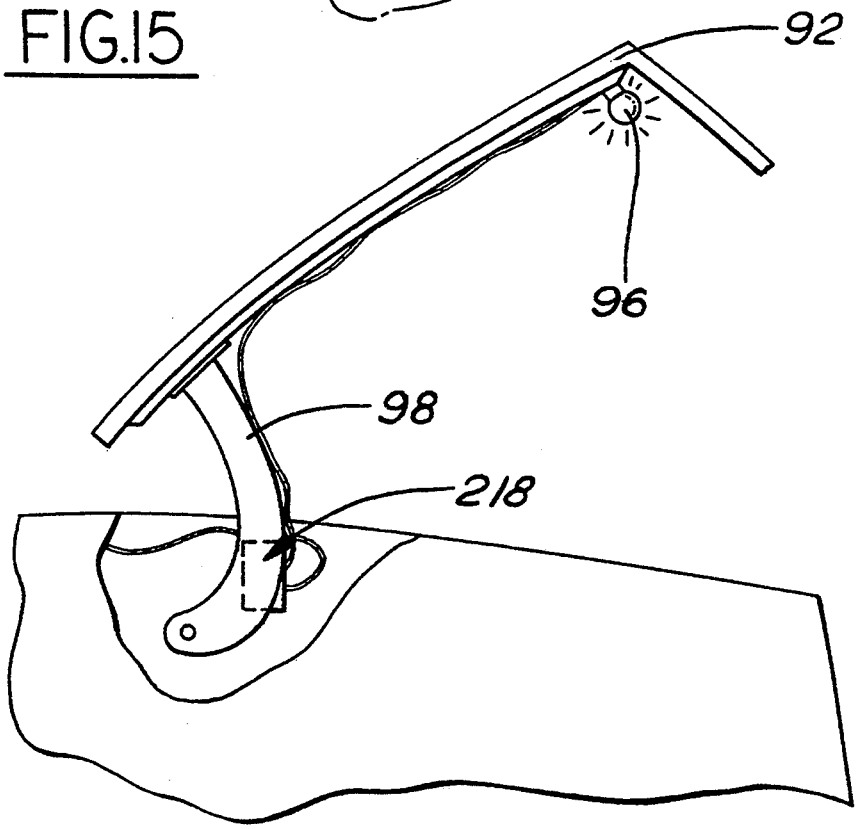
FIG. 16 is a plan view of the switch mounted on a deck lid hinge when the deck lid is in the open position and the switch is in the closed position.

Referring now to FIGS. 14–16, switch 218 can also be adapted to fit on a moving panel such as a decklid 92 which encloses the luggage compartment of an automobile. Slide connector 222 is attached to decklid 92 in a convenient location such as on a hinge 98. Baseplate 220 is attached to a stationary location such as a body panel 94 so that when decklid 92 is in the open position (FIGS. 14 and 16), baseplate 220 becomes electrically connected to slide connector 222 and thereby illuminates fight 96. Hinge 98 guides decklid 92 in a fixed path relative to the body panel 94.

The switch has many potential applications in automotive as well as non-automotive applications for sliding members. Thus, the scope of the invention is not limited to the illustrations described in the preferred embodiment, since variations would be obvious to those skilled in the art.

What is claimed is:

1. A slide plate switch assembly comprising: a stationary member including guide means for defining a slide path, and including a power terminal disposed in a predetermined relation to said slide path; and a sliding member including follower means for mating with said guide means, including contact means disposed in said predetermined relation to said slide path for contacting said power terminal when said sliding member is moved in relation to said stationary member, including an electrical load for receiving power when said contact means is electrically connected to said power terminal and including a second housing means mounted thereon for retractably securing said contact means and including a retractable sleeve means for surrounding said contact, said retractable sleeve being retracted when said sliding member mates with said stationary member.

2. A slide plate switch assembly as in claim 1 wherein said stationary member has a first housing means for selectively covering said power terminal.

3. A slide plate switch assembly as in claim 2 wherein said first housing means includes a flexible insulator means for covering said power terminal.

4. A slide plate switch assembly as in claim 1 wherein said first housing means has an angularly sloped surface for retracting said retractable sleeve.

5. A slide plate switch assembly as in claim 1 wherein said sliding member is an ashtray.

6. A slide plate switch assembly as in claim 1 wherein said sliding member is a decklid.

7. A slide plate switch assembly as in claim 1 wherein said sliding member is a sun visor.

8. A slide plate switch assembly as in claim 1 wherein said electrical load is a light source.

9. A slide plate switch assembly for mounting between a stationary member and a sliding member comprising:

a slide connector for mounting on said sliding member including;

a first housing having a first surface with an opening;

a first contact being retractably secured within said first housing, said first contact extending through said opening in said first surface; and a first insulator surrounding said first contact, retractably secured independently from said first contact, within said housing and extending through said opening and axially retracting deforming into said housing when a force is applied to said first insulator; and a base plate for mounting on said stationary member including;

a second housing having a second surface with a channel, said channel being wider than said first contact but narrower than said first insulator;

a conductive pad within said second housing so that said conductive is recessed within said channel;

a third surface acutely angled from said frame to said second surface;

a pliant second insulator coveting said channel;

where upon engagement of said slide connector with said base plate said conductive pad is exposed and said first contact electrically connects to said conductive pad.

10. A switch assembly as in claim 9 wherein said sliding member is an ashtray.

11. A switch assembly as in claim 9 wherein said sliding member is a decklid.

12. A switch assembly as in claim 9 wherein said sliding member is a sun visor.

13. A switch assembly as in claim 9 wherein said pliant second insulator is comprised of two semi-circular flaps.

14. A switch assembly as in claim 13 wherein said pliant second insulator is made of robber.

15. An ashtray assembly comprising:

an ashtray frame;

an ashtray slidably mounted within said ashtray frame; and a switch means for connecting an electrical source to an electrical load, said switch comprising a slide connector and a base plate;

said slide connector for mounting on one of said ashtray or said ashtray frame housing including;

a first housing having a first surface with an opening;

a first contact being retractably secured within said first housing, said first contact extending through said opening in said first surface;

a first insulator surrounding said first contact, retractably secured independently from said first contact, within said housing and extending through said opening and axially retracting into said housing when a force is applied to said first insulator;

said base plate mounted on the other one of said ashtray or said ashtray frame including;

a second housing having a second surface with a channel, said channel being wider than said first contact but narrower than said first insulator;

a conductive pad secured within said second housing so that said conductive pad is recessed within said channel;

a third surface acutely angled from said second panel to said second surface; and a pliant second insulator coveting said channel; whereby upon engagement of said slide connector with said base plate, said conductive pad is exposed and said first contact electrically connects to said conductive pad.

* * * * *